US011166510B2

(12) United States Patent
Newman et al.

(10) Patent No.: US 11,166,510 B2
(45) Date of Patent: Nov. 9, 2021

(54) PROTECTIVE HEADGEAR

(71) Applicant: Cascade Maverik Lacrosse, LLC, Exeter, NH (US)

(72) Inventors: Jesse Newman, Liverpool, NY (US); Nicholas Colville, Syracuse, NY (US); David Winthrop Fream, Newfields, NH (US); Stephen Moore, Liverpool, NY (US)

(73) Assignee: Cascade Maverik Lacrosse, LLC, Exeter, NH (US)

( * ) Notice: Subject to any disclaimer, the term of this patent is extended or adjusted under 35 U.S.C. 154(b) by 0 days.

(21) Appl. No.: 15/896,566

(22) Filed: Feb. 14, 2018

(65) Prior Publication Data

US 2018/0192729 A1 Jul. 12, 2018

Related U.S. Application Data

(62) Division of application No. 14/679,894, filed on Apr. 6, 2015, now Pat. No. 9,943,129.

(51) Int. Cl.
*A42B 3/06* (2006.01)
*A42B 3/20* (2006.01)

(52) U.S. Cl.
CPC ..... *A42B 3/069* (2013.01); *A42B 3/20* (2013.01)

(58) Field of Classification Search
CPC .. A42B 3/069; A42B 3/20; A42B 3/06; A42B 3/062
See application file for complete search history.

(56) References Cited

U.S. PATENT DOCUMENTS 3,818,508 A 6/1974 Lammers et al.
4,843,647 A 7/1989 Phillips, Sr.
5,083,320 A * 1/1992 Halstead ..... A42B 3/122 2/413
5,088,130 A * 2/1992 Chiarella ..... A42B 3/066 2/411
5,271,103 A 12/1993 Darnell
(Continued)

FOREIGN PATENT DOCUMENTS

EP 1 199 000 A2 4/2002

OTHER PUBLICATIONS

[No Author Listed] Standard Specification for Headgear Used in Women's Lacrosse (excluding goalkeepers). ASTM. Draft Work Item No. WK36457. Nov. 13, 2014. 23 pages.

*Primary Examiner* — Shaun R Hurley
*Assistant Examiner* — Bao-Thieu L Nguyen
(74) *Attorney, Agent, or Firm* — Wolf, Greenfield & Sacks, P.C.

(57) ABSTRACT

Aspects herein relate to protective headgear for sports and to methods of using such headgear. In one aspect, the headgear has an external head-protecting shell that is soft to reduce the risk of injuring other players. In another aspect, the headgear has a rear closure arrangement that includes a bridge component for ease of putting on the headgear and for added protection at the closure area of the rear closure arrangement. In another aspect, fit pads of different sizes are removeably attachable to a cheekbone extension member of the headgear to provide a proper fit to the wearer's cheekbone. A face mask is integrated with the headgear in some embodiments.

17 Claims, 11 Drawing Sheets

(56) References Cited

U.S. PATENT DOCUMENTS 5,392,468 A * 2/1995 Leddick, III ..... A42B 3/0473 2/424
5,515,543 A 5/1996 Gioello
5,666,670 A 9/1997 Ryan et al.
5,669,075 A 9/1997 Weeks
5,790,988 A 11/1998 Guadignino, Jr. et al.
5,857,219 A 1/1999 Edmark
5,930,841 A 8/1999 Lampe et al.
6,065,159 A 5/2000 Hirsh
6,154,889 A 5/2000 Morre, III et al.
6,266,827 B1 7/2001 Lampe et al.
6,292,954 B1 9/2001 O'Bradaigh et al.
6,339,849 B1 1/2002 Nelson et al.
6,349,416 B1 2/2002 Lampe et al.
6,389,607 B1 5/2002 Wood
6,389,608 B1 5/2002 Williams
6,381,760 B1 7/2002 Lampe et al.
6,446,270 B1 * 9/2002 Durr ..... A42B 3/061 2/412
6,625,820 B1 9/2003 Lampe
6,658,671 B1 * 12/2003 Von Holst ..... A42B 3/064 2/412
6,665,884 B1 12/2003 Demps et al.
7,127,747 B2 10/2006 Darnell et al.
7,341,776 B1 * 3/2008 Milliren ..... A41D 13/05 2/411
7,802,319 B2 * 9/2010 Shaver ..... A42B 3/0406 2/410
7,930,771 B2 * 4/2011 Depreitere ..... A42B 3/064 2/411
8,028,349 B2 4/2011 Petzl et al.
8,042,198 B1 10/2011 Cleveland
8,117,679 B2 2/2012 Pierce
8,176,574 B2 5/2012 Bryant et al.
8,484,762 B2 7/2013 Goldstein
8,615,817 B2 * 12/2013 Phillips ..... A42B 3/064 2/2.5
8,898,819 B2 2/2014 Cleva
8,732,868 B2 5/2014 Ellis
8,863,320 B2 10/2014 Kelly et al.
8,938,817 B1 * 1/2015 Baldi ..... A42B 3/069 2/411
8,943,617 B2 * 2/2015 Harty ..... A42B 3/285 2/468
8,984,670 B2 3/2015 Cleva
9,220,311 B1 * 12/2015 Baldi ..... A42B 3/00
9,382,415 B2 7/2016 Avakian et al.
9,486,029 B2 11/2016 Galaitsis et al.
9,776,064 B2 * 10/2017 Harty ..... A61B 5/01
9,808,042 B2 * 11/2017 Hoying ..... A42B 3/069
9,833,684 B2 * 12/2017 Warmouth ..... A42B 3/20
9,943,129 B2 * 4/2018 Newman ..... A42B 3/20
2006/0059606 A1 * 3/2006 Ferrara ..... A42B 3/064 2/412
2008/0066208 A1 3/2008 Tagliente
2008/0155735 A1 * 7/2008 Ferrara ..... A01N 25/18 2/412
2009/0031481 A1 2/2009 Dennis et al.
2009/0178184 A1 * 7/2009 Brine, III ..... A42B 3/124 2/414
2010/0071114 A1 3/2010 Jaeger
2010/0186150 A1 * 7/2010 Ferrara ..... A42B 3/128 2/412
2010/0221151 A1 9/2010 Motadel et al.
2011/0016595 A1 1/2011 Brace et al.
2011/0056004 A1 3/2011 Landi
2011/0209265 A1 9/2011 Komada et al.
2011/0225705 A1 9/2011 Fernandes et al.
2011/0271430 A1 * 11/2011 Lowe ..... A63B 71/10 2/425
2012/0000008 A1 * 1/2012 Baldackin ..... A42B 3/065 2/410
2012/0005810 A1 * 1/2012 Cheng ..... A42B 3/06 2/425
2012/0047636 A1 1/2012 Fehmel et al.
2012/0027972 A1 2/2012 Kapur et al.
2012/0047635 A1 * 3/2012 Finiel ..... A42B 3/125 2/414
2012/0196147 A1 8/2012 Rabiei
2013/0067629 A1 3/2013 Moore et al.
2013/0230836 A1 * 9/2013 Rosenthal ..... A42B 3/067 434/262
2013/0298317 A1 11/2013 Fonte et al.
2013/0232670 A1 12/2013 Janetos
2014/0000007 A1 1/2014 Fukushima
2014/0047621 A1 2/2014 Toney et al.
2014/0068840 A1 3/2014 Nauman et al.
2014/0130239 A1 * 5/2014 Preston-Powers ..... A42B 3/285 2/411
2014/0155540 A1 6/2014 Imai et al.
2014/0196198 A1 7/2014 Cohen
2014/0223641 A1 * 8/2014 Henderson ..... A42B 3/065 2/411
2014/0259310 A1 9/2014 Ricket et al.
2014/0298571 A1 9/2014 Dagan
2014/0331391 A1 11/2014 Storelli et al.
2014/0373257 A1 * 12/2014 Turner ..... A42B 3/125 2/414
2015/0029586 A1 1/2015 Clerc et al.
2015/0096102 A1 4/2015 Dick
2015/0113718 A1 * 4/2015 Bayer ..... A41D 13/0512 2/461
2015/0143617 A1 * 5/2015 Suddaby ..... A42B 3/064 2/414
2015/0223544 A1 * 8/2015 Rosenthal ..... A42B 3/067 2/411
2015/0223546 A1 8/2015 Cohen
2015/0223547 A1 8/2015 Wibby
2015/0230537 A1 * 8/2015 Warmouth ..... A42B 3/20 2/414
2015/0237946 A1 8/2015 Simpson
2015/0257470 A1 9/2015 Vito et al.
2015/0267026 A1 9/2015 Leventis et al.
2015/0272255 A1 * 10/2015 Galaitsis ..... A42B 3/121 2/413
2015/0320134 A1 * 11/2015 Stalker ..... A63B 71/10 2/411
2016/0015111 A1 * 1/2016 Latruffe ..... A42B 3/06 2/412
2016/0021965 A1 * 1/2016 Mayerovitch ..... A42B 3/12 2/414
2016/0021966 A1 * 1/2016 Warmouth ..... A42B 3/20 2/413
2016/0053843 A1 2/2016 Subhash et al.
2016/0095375 A1 * 4/2016 Ho ..... A42B 3/128 2/411
2016/0166435 A1 6/2016 Wilson
2016/0286883 A1 * 10/2016 Newman ..... A42B 3/20
2016/0346897 A1 12/2016 Reedy et al.
2017/0120134 A1 * 5/2017 Warmouth ..... A63B 71/081
2017/0367428 A1 * 12/2017 Bayer ..... A42B 3/14

* cited by examiner

PROTECTIVE HEADGEAR

CROSS REFERENCE OF RELATED APPLICATIONS

This application is a divisional application and claims the benefit under 35 U.S.C. § 120 of U.S. application Ser. No. 14/679,894, filed Apr. 6, 2015, entitled "PROTECTIVE HEADGEAR," the contents of which are herein incorporated by reference in their entirety.

FIELD

Aspects of the disclosure relate to protective headgear for sports and to methods of using such headgear.

BACKGROUND

In certain sports, particularly in contact sports, head injury may occur due to collision or abrasion of the head against other players, sports equipment such as a stick or a ball, or the ground. In some sports, players are required to wear headgear to protect against head injuries. In other sports, such as soccer, field hockey and women's lacrosse, headgear is not traditionally worn.

SUMMARY

According to one aspect, a protective headgear, such as for a women's lacrosse player, includes an external head-protecting shell comprising a thermoplastic polymer having a void fraction of less than 20%. The external head-protecting shell has a crown portion, left and right side portions, and a rear portion. The protective headgear further includes an inner padding attached to the shell. The external head-protecting shell has a hardness of 25 to 70 Shore D and/or a hardness of 70 to 100 Shore A.

According to another aspect, a protective headgear, such as for a women's lacrosse player, includes an external head-protecting shell. The external head-protecting shell has a crown portion, left and right side portions, and a rear portion. The protective headgear also includes an inner padding. The headgear is configured to satisfy at least two of the following tests of ASTM WK36457 proposed Nov. 13, 2014: the Deformation Test, the Shock Absorption Test, and the Ball Impact Absorption Test.

According to yet another aspect, a protective headgear, such as for a women's lacrosse player, includes an external head-protecting shell having a first end portion, and a second end portion. Each of the first and second end portions are located on a rear side of the shell and the second end portion is moveable relative to the first end portion. The protective headgear further includes a tightener attached to the shell. The tightener is constructed and arranged to move the second end portion toward the first end portion to tighten the shell. The protective headgear further includes a bridge component attached at a rear of the shell to at least partially stabilize the headgear on a wearer's head prior to tightening of the shell. When the tightener tightens the shell, the tightener tightens the shell around the wearer's head and at least a portion of the bridge component overlaps with at least a portion of the first end portion and/or the second end portion.

According to another aspect, a protective headgear, such as for a women's lacrosse player, includes an external head-protecting shell to at least partially cover a wearer's head. The protective headgear includes a cheekbone extension member extending from the shell to at least partially cover a cheekbone area of the wearer's head. The cheekbone extension member has an inwardly-facing surface. The protective headgear further includes a first cheekbone fit pad that is removably attachable to the cheekbone extension member such that the cheekbone fit pad covers at least a portion of the inwardly-facing surface of the cheekbone extension member. The protective headgear further includes a second cheekbone fit pad that is interchangeable with the first cheekbone fit pad such that the second cheekbone fit pad is removably attachable to the inwardly-facing surface of the cheekbone extension member after the first cheekbone fit pad has been removed from the cheekbone extension member. The second cheekbone fit pad has a different thickness than the first cheekbone fit pad.

According to a further aspect, a protective headgear, such as for a women's lacrosse player, includes an external head-protecting shell to at least partially cover a wearer's head. The shell includes a first downwardly-angled rear portion extending from a first side portion of the shell toward a rear of the shell, and further includes a second downwardly-angled rear portion extending from a second side portion of the shell toward the rear of the shell. The first downwardly-angled rear portion has a first upper edge, and the first upper edge forms an angle of between 30 and 50 degrees inclusive relative to a horizontal plane when the headgear is oriented as if being worn by a wearer standing in an upright position and pointing his or her head straight forward. The second downwardly-angled rear portion has a second upper edge, and the second upper edge forms an angle of between 30 and 50 degrees inclusive relative to the horizontal plane. The first and second downwardly-angled rear portions form an opening between the first and second upper edges and a lower edge of an upper rear portion of the shell.

In another aspect, a protective apparatus, such as for a women's lacrosse player, includes an external head-protecting shell, the external head-protecting shell having a crown portion, left and right side portions and a rear portion, and a front portion which is forward of a halfway line that is halfway between a forwardmost point of the head-protecting shell and a rearmost point of the head-protecting shell. The external head-protecting shell has a hardness of 25 to 70 Shore D and/or a hardness of 70 to 100 Shore A. A protective face mask is attached to the front portion of the head-protecting shell without a strap.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. Various embodiments of the invention will now be described, by way of example, with reference to the accompanying drawings, in which.

DETAILED DESCRIPTION

Figure 1:
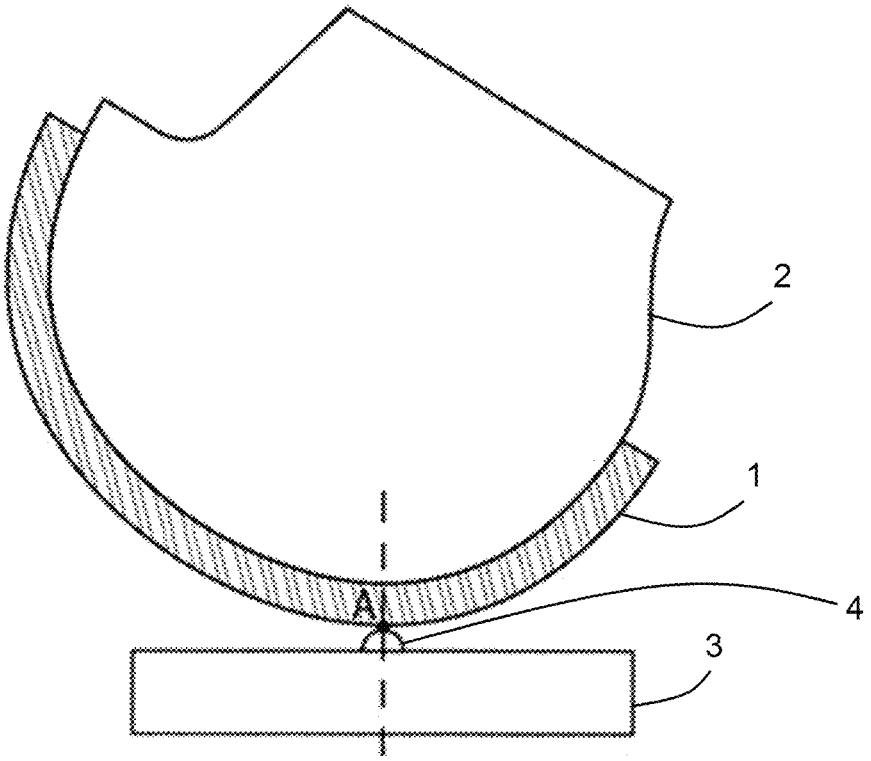
FIG. 1 is a schematic of a mechanical test arrangement.

Aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

Various embodiments are described in connection with protective headgear for sports, and in particular, headgear which may be used for women's lacrosse. According to US Lacrosse, which is the national governing body of lacrosse in the United States, women's lacrosse is officially a non-contact sport and only certain types of incidental contact are permitted. However, women's lacrosse is a high speed sport during which injuries can occur, both from legal, incidental contact and illegal contact. In women's lacrosse, helmets, face masks, and gloves historically have not been mandatory. US Lacrosse recommended protective eyewear in women's lacrosse in 2004 and made it mandatory for women at all levels of play in 2005.

According to a four-year study published in the American Journal of Sports Medicine, although the sport permits only incidental contact, women's lacrosse had higher rates of head, face, and eye injuries at both the high school and collegiate levels than men's lacrosse, which permits contact. Concussions were found to be the most common injury for women's lacrosse. The study proposes that the relatively limited mandatory head protection for women's lacrosse as compared to men's lacrosse may be a factor in the rates of injury in women's lacrosse.

In response to growing concerns about head injuries in women's lacrosse, US Lacrosse is working with the American Society for Testing and Materials (ASTM) to develop a headgear standard players of women's lacrosse. A new standard for headgear in women's lacrosse, ASTM WK36457, dated Nov. 13, 2014, has been proposed by ASTM International Subcommittee F08.53 on Headgear and Helmets. Some embodiments described herein satisfy one or more of the requirements set forth in proposed ASTM WK36457.

According to one aspect of the present disclosure, protective headgear is provided to be used when playing sports, such as women's lacrosse as one example. The protective headgear may be easy to put on and remove, comfortable, and meet at least some of the requirements set forth in proposed ASTM WK36457. According to one aspect, the headgear is provided with a soft, external head-protecting shell. According to another aspect, the protective headgear has a rear closure arrangement that helps to initially stabilize the helmet before fully securing the helmet. According to yet another aspect, the rear closure arrangement provides protection at the back of the wearer's head. According to yet another aspect, headgear is provided with replaceable, removable fit pads such that the wearer can select a fit pad that provides a proper fit to a front portion of the wearer's head, such as on the wearer's cheek.

Proposed Headgear Standard

Proposed ASTM WK36457 includes at least three mechanical testing requirements. Each will be briefly summarized in turn:

1. Deformation Test

The Deformation Test includes colliding headgear against an impact surface and determining the amount of deformation experienced by the headgear. The headgear must deform by a certain amount in order to satisfy the Deformation Test. Proposed ASTM WK36457 states, "exterior surfaces of the headgear portion must be of a soft composition and this is to be confirmed by using the deformation test." During the Deformation Test, portions of the headgear that are related to eyewear protection may be removed from the headgear.

As seen in FIG. 1, headgear 1 is attached to a test headform 2, which is attached to a free fall drop assembly (not shown) by an adjustable mounting. The adjustable mounting allows impacts to be delivered to any prescribed point on the headgear. The impact surface is a flat modular elastomer programmer (MEP) 3 with a rod anvil 4. The rod anvil is affixed to the top of the MEP surface and is centrally located so as to bisect the MEP surface into equal halves. The rod anvil is of steel construction and is rigidly attached to the MEP surface so that the anvil does not move during the Deformation Test. The impact surface is covered with a layer of contact paste.

To satisfy the proposed Deformation Test, the headgear must make contact with the MEP on both sides of the half-rod anvil as indicated by contact paste. The headgear must be capable of meeting this requirement throughout the headgear's full range of adjustment.

As shown in FIG. 1, the test headform 2 and headgear 1 are positioned such that the lowest point A on the headgear 1 is also the first point of contact between the rod anvil 4 and the headgear 1 (see FIG. 1). According to the Deformation Test of currently proposed ASTM WK36457, the impact velocity shall be 1.5 m/s±0.1 m/s (4.9 ft/s±0.3 ft/s). The MEP is 152.4 mm (6 in.) in diameter and 25.4 mm (1 in.) in thickness. The MEP has an impact surface hardness of 60±5 Shore A. A base supporting the MEP consists of a rigid slab weighing at least 136.1 kg (300 lb.). The MEP is mounted on an aluminum plate with a minimum thickness of 5.6 mm (0.220 in.) after grinding. The rod anvil 4 is one half of a cylinder with a diameter of 12.7 mm (0.5 in.)±0.5 mm and a minimum length of 152.4 mm (6 in.). The layer of contact paste must be no thicker than 1.59 mm (0.0625 in.).

2. Shock Absorption Test

The Shock Absorption Test includes colliding headgear against an impact surface and measuring the acceleration of the impact experienced by the headgear. The headgear is attached to a test headform, which is attached to a free fall drop assembly in the same arrangement as that described above for the Deformation Test. The impact surface is also the same as that described above for the Deformation Test. According to the Shock Absorption Test, the impact velocity shall be 2.2 m/s±0.1 m/s (7.2 ft/s±0.3 ft/s). The time interval between impacts is between 30 to 90 seconds.

To satisfy the Shock Absorption Test, the peak acceleration of any impact cannot exceed 80 g. The headgear must be capable of meeting this requirement throughout the headgear's full range of adjustment.

3. Ball Impact Absorption Test

In the Ball Impact Absorption Test, projectiles are propelled toward the headgear and, upon collision of each projectile with the headgear, the acceleration of impact experienced by the headgear is measured. A propelling device hurls a projectile horizontally toward the headgear at the front, side and rear locations of the headgear at an impact velocity of 27 m/s±0.8 m/s. The test projectiles are balls intended for use in women's lacrosse and must meet the requirements of the National Operating Committee on Standards for Athletic Equipment (NOCSAE) NOSCAE Document 049 (ND049).

To satisfy the Ball Impact Absorption Test of proposed ASTM WK36457, the peak acceleration of any impact cannot exceed 80 g and the headgear must be capable of meeting this requirement throughout the headgear's full range of adjustment.

Protective Headgear

Aspects of the present disclosure relate to protective headgear for sports and to methods of using such headgear. In some embodiments, the headgear satisfies one or more of the mechanical testing requirements of proposed ASTM WK36457. While aspects of the headgear may be discussed in relation to women's lacrosse, it should be understood that the disclosed headgear may be used in any suitable contact, semi-contact, limited-contact or non-contact sport, and may be used by either men or women. Some examples of possible sports besides lacrosse in which the disclosed headgear or aspects of the disclosed headgear may be used include, but are not limited to, field hockey, rugby, soccer, mixed martial arts, basketball, squash, racquetball, water polo, handball, ultimate, wrestling and boxing.

External Head-Protecting Shell

The inventors have appreciated that headgear made of a hard outer material may potentially injure other players during contact with the headgear, particularly in sports where players are not required and do not typically wear body/head protection. As such, the inventors have recognized that it can be advantageous to use sports headgear which not only protects the wearer, but also limits the potential for the helmet to injure other players. According to one aspect, headgear is provided with a soft, external head-protecting shell. As used herein, a soft, external head-protecting shell is defined to be one that satisfies the Deformation Test described above.

The external head-protecting shell is a shell that is external to an internal layer (or layers) of padding and/or cushioning. In some embodiments, the external head-protecting shell is the outermost layer of the headgear that provides protection to the wearer's head in some embodiments. In other embodiments, an additional layer (or layers) of padding or other protection may be present on the outside of the external head-protecting shell such that the external head-protecting shell is not the outermost layer. It should be appreciated that aesthetic additions to the headgear which do not provide protection to the wearer's head, such as paint, decals, or stickers, may be applied to the outer surface of the head-protecting shell, and the head-protecting shell would still be considered the outermost layer of the headgear.

Figure 2:
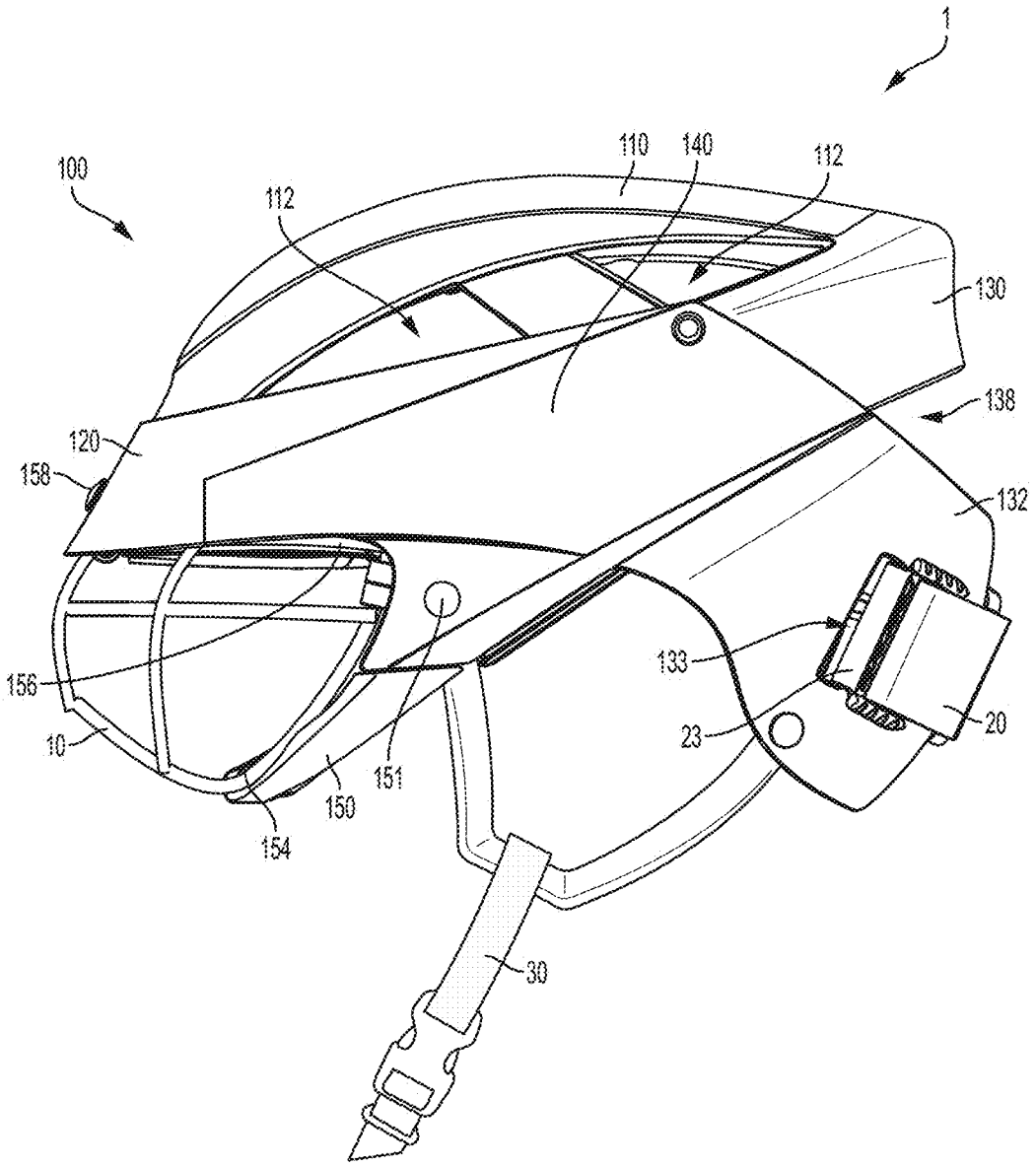
FIG. 2 is a right side view of headgear having a soft external head-protecting shell according to one embodiment.
Figure 3:
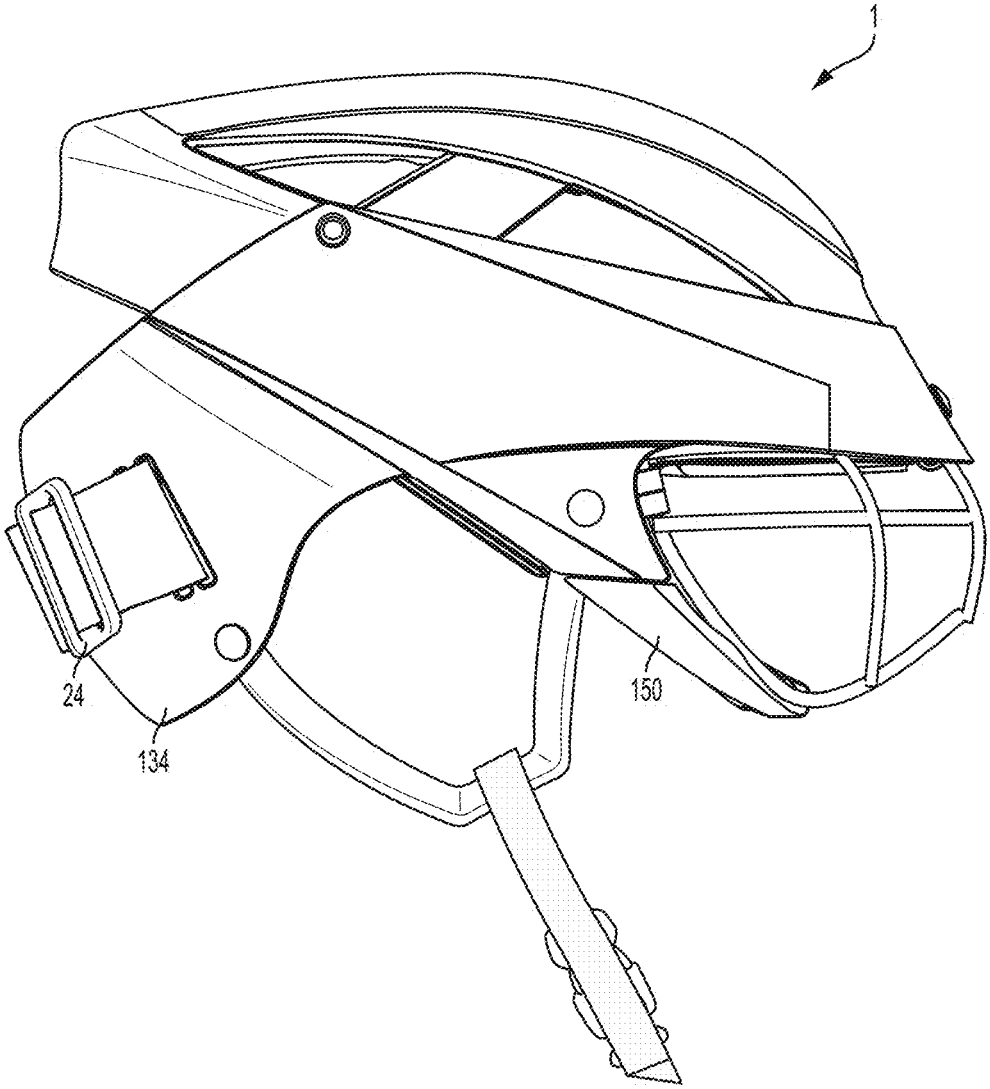
FIG. 3 is a left side view of the headgear shown in FIG. 1.
Figure 4:
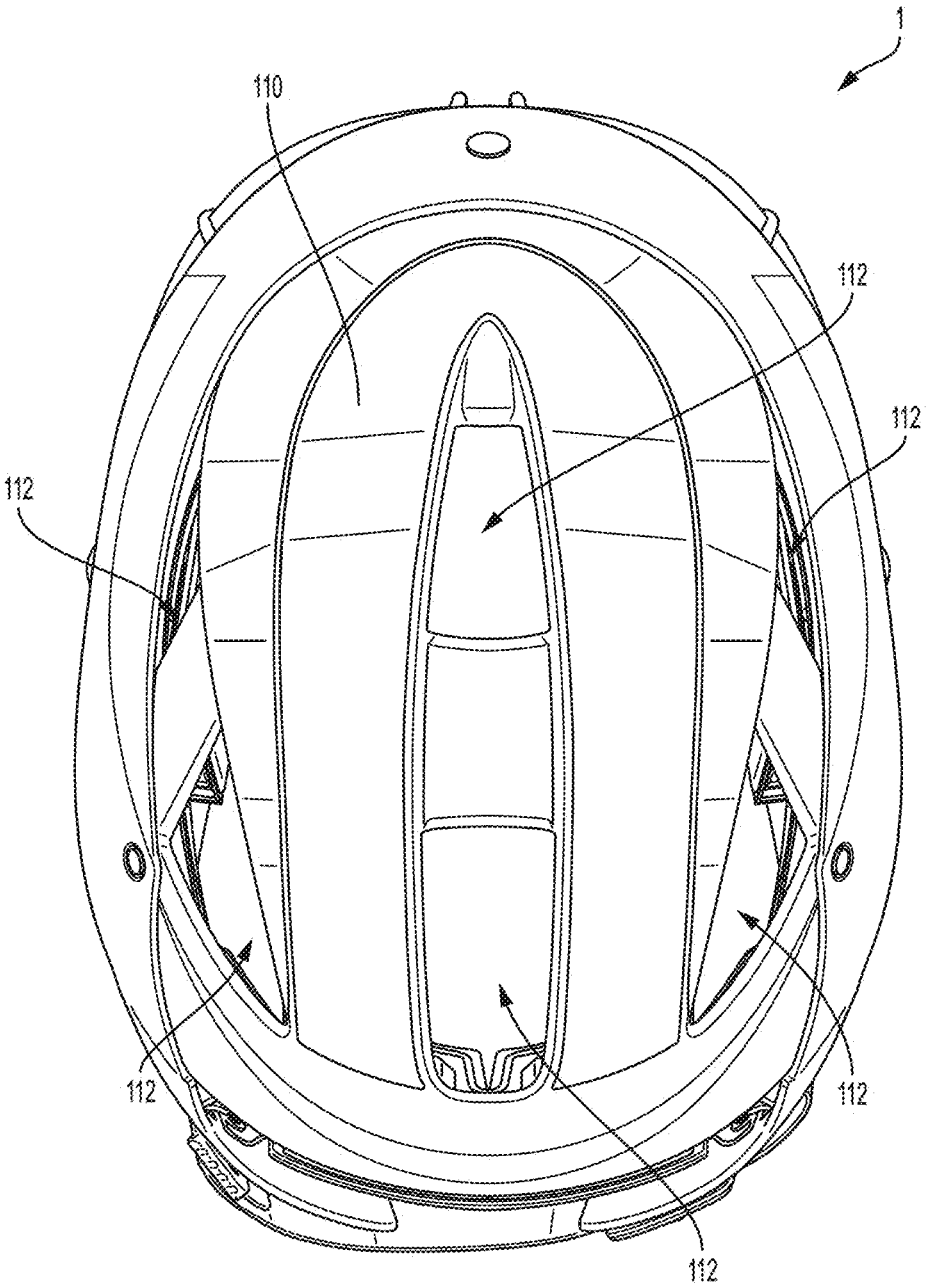
FIG. 4 is a top view of the headgear shown in FIG. 1.

Turning to the figures, FIGS. 2-4 depict an embodiment of a headgear 1 having a soft external head-protecting shell 100. The external head-protecting shell 100 may include a crown portion 110, a frontal headband portion 120, a rear portion 130 and side portions 140. In some embodiments, the headgear may include a cheekbone extension member 150, which is discussed in a later section. In some embodiments, the head-protecting shell may include one or more vents 112. The crown portion 110, frontal headband portion 120, rear portion 130 and side portions 140 of the external head-protecting shell 100 are constructed and designed to at least partially cover the crown, front, rear, and sides of a wearer's head, respectively.

In some embodiments, the external head-protecting shell has a hardness of 25 to 70 Shore D, or 30 to 70 Shore D, or 30 to 60 Shore D, or 33 to 58 Shore D, or 40 to 50 Shore D. When measured for Shore A hardness, the external head-protecting shell has a hardness of 70 to 100 Shore A in some embodiments, or 90 to 99 Shore A. The shell may be within one or both of a Shore D range and a Shore A range provided above. In some embodiments, the external head-protecting shell is made of a thermoplastic polymer having a void fraction of less than 20%. The thermoplastic polymer may be thermoplastic elastomer (TPE), thermoplastic polyurethane (TPU), or any other suitable thermoplastic polymer. The void fraction of the thermoplastic polymer may be less than 10% in some embodiments, may be less than 5% in some embodiments, and may be a solid thermoplastic polymer in some embodiments. The external head-protecting shell may have a thickness of 0.050 to 0.100 inches, 0.050 to 0.090 inches, 0.050 to 0.15 inches, or any other suitable thickness.

Figure 5:
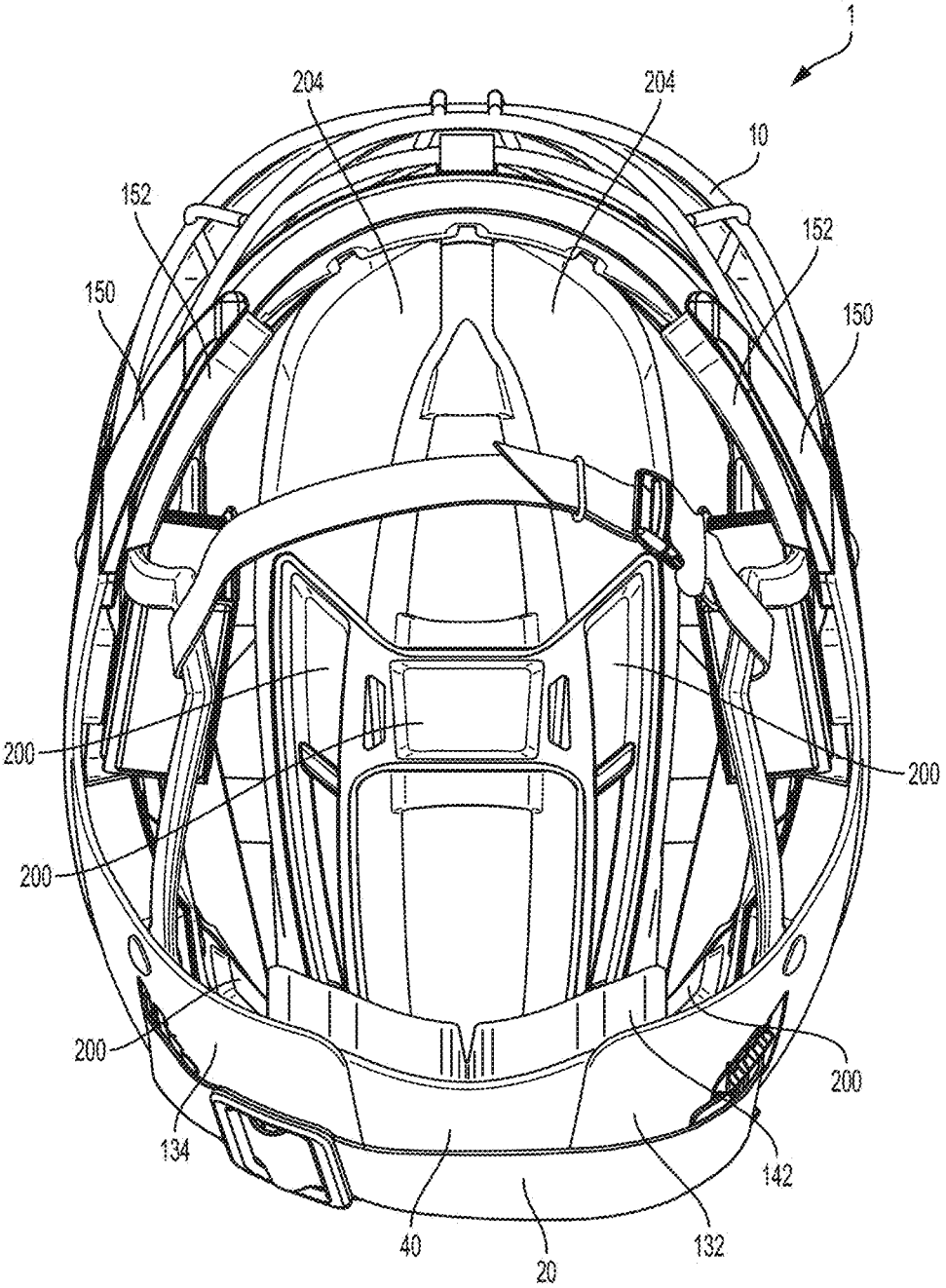
FIG. 5 is a bottom view of headgear having inner padding according to one embodiment.
Figure 6:
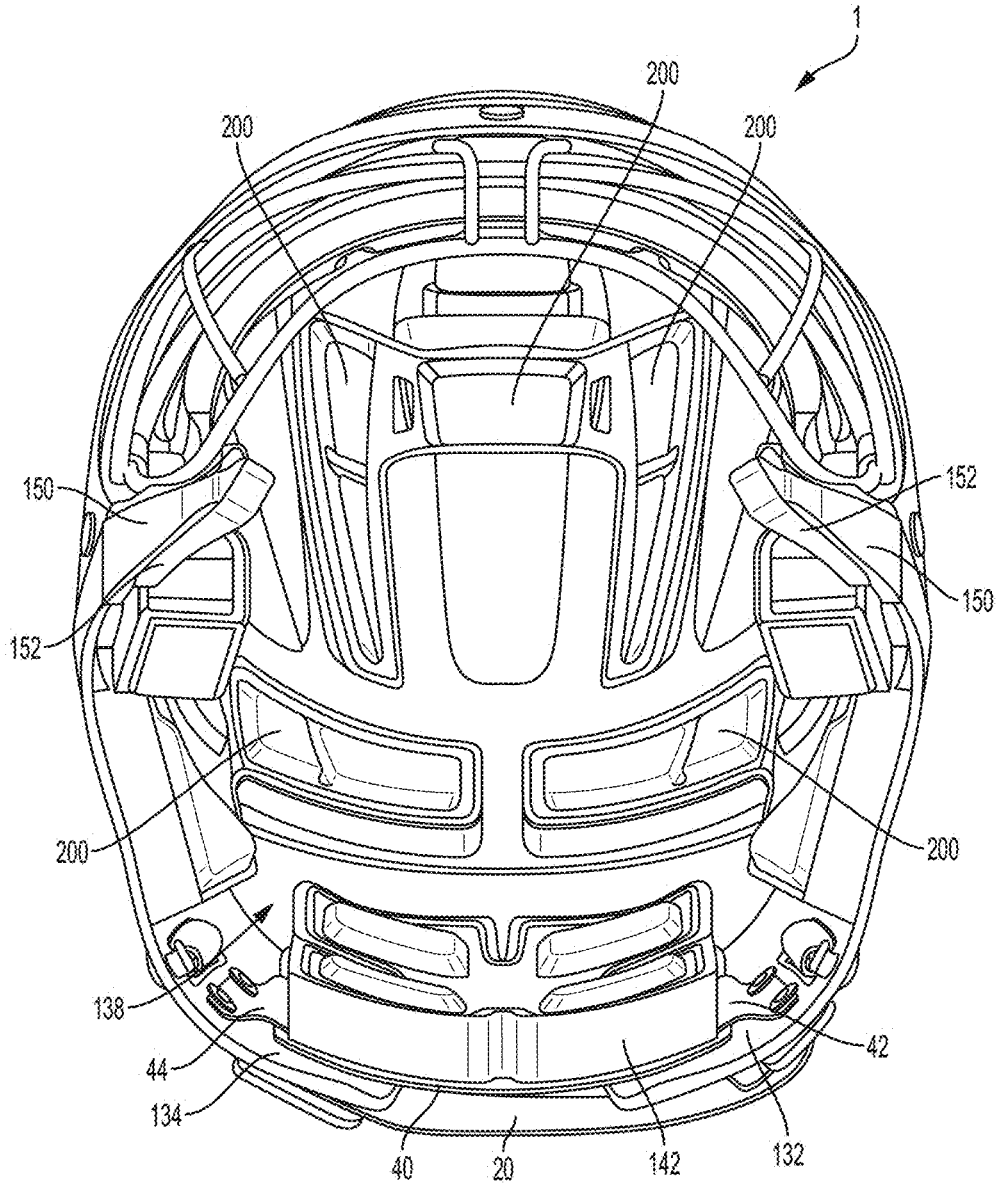
FIG. 6 is a bottom perspective view of the headgear shown in FIG. 5.

As seen in FIGS. 5-6, the headgear 1 includes inner padding that is attached to the external head-protecting shell 100 by any suitable arrangement as is well known in the art. As used herein, the term "attached" includes, but is not limited to, arrangements in which items are directly attached to one another. Additionally, a first item can be considered to be attached to a second item by being attached to the second item via an intermediate component or components.

Different types of inner padding may be included in the headgear. In some embodiments, the inner padding is softer than the external head-protecting shell. In one embodiment, best seen in FIGS. 5, 6 and 8, the headgear includes primary padding 200, secondary padding 204, front padding 260 and temple padding 250.

Primary padding 200 and secondary padding 204 may be made of one or more layers. In an arrangement with more than one layer, each layer may be made of a different material. In some embodiments, the layer of the padding closest to the external head-protecting shell has a harder Shore hardness than that of the layer of the padding furthest from the external head-protecting shell. In arrangements where the padding has three or more layers, the layers may be arranged from highest Shore hardness to lowest Shore hardness as one moves from the external head-protecting shell toward the inside of the headgear. As such, moving from the external head-protecting shell toward the inside of the headgear, each layer is successively lower in Shore hardness. Arranging padding layers from hardest to softest in the outside to inside direction may help to absorb energy when the headgear is subjected to impact. In some embodiments, the external head-protecting shell has a higher Shore hardness than any of the layers of the internal padding.

Figure 7:
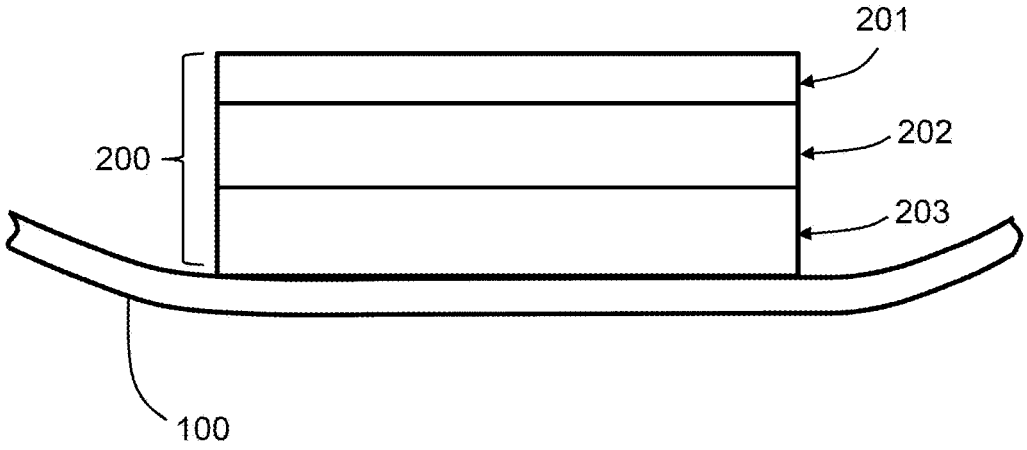
FIG. 7 is a schematic of a cross section of the primary inner padding and external head-protecting shell.

One illustrative embodiment is shown in FIG. 7 with a schematic cross-section through primary padding 200 and the external head-protecting shell 100. The primary padding 200 comprises three layers of different materials. The outermost layer 203, which is the layer closest to the external head-protecting shell 100, has the highest Shore D hardness. A middle layer 202 has a lower Shore D hardness than that of outermost layer 203, but a higher Shore D hardness than that of an innermost layer 201. Innermost layer 201, which is the layer closest to the wearer's head when the headgear is worn, has the lowest Shore D hardness.

Each of the layers may have a thickness of 0.05 to 1.0 inches, or any other suitable thickness. In some embodiments, the innermost layer may have a thickness of 0.06 to 0.26 inches, 0.1 to 0.2 inches, or 0.15 inches. In some embodiments, the middle layer may have a thickness of 0.15 to 0.4 inches, 0.18 to 0.38 inches, 0.2 to 0.5 inches, or 0.3 inches. In some embodiments, the outermost layer may have a thickness of 0.15 to 0.4 inches, 0.18 to 0.38 inches, 0.2 to 0.5 inches, or 0.3 inches. In various embodiments, each of the layers may have a thickness of between 0.1 and 0.5 inches.

In some embodiments, the innermost layer has the smallest thickness compared to the middle layer and the outermost layer. In some embodiments, the thickness of the external head-protecting shell is smaller than or equal to the thickness of each of the layers of the primary padding.

In some embodiments, the innermost layer 201 is made of a urethane foam, such as PORON XRD® cellular urethane foam. The urethane foam may be compression molded, die cut, or processed by any other suitable method. In some embodiments, the middle layer 202 is made of a vinyl nitrate foam, such as vinyl nitrile VN600 (Der-Tex Corporation). In some embodiments, the outermost layer 203 is made of a vinyl nitrate foam with a different density than that of the middle layer 202, such as vinyl nitrile VN1000 (Der-Tex Corporation). However, it should be appreciated that, for each layer, other suitable materials may be used. For example ethylene-vinyl acetate (EVA) may be used for any of the layers.

In some embodiments, the headgear includes areas of padding with fewer layers than the primary padding. In one illustrative embodiment shown in FIGS. 5 and 8, the headgear includes areas of secondary padding 204. Secondary padding 204 may have fewer layers than primary padding 200. In some embodiments, secondary padding 204 contains only two layers of padding. In one embodiment, the secondary padding 204 is the same as the primary padding 200 but without the innermost layer 201. Like the primary padding 200, the secondary padding may be arranged such that the higher Shore hardness layer is closest to the external head-protecting shell 100.

It should be appreciated that more or fewer layers maybe used in the primary and secondary padding. In some embodiments, some or all of the layers may be made of the same material. In some embodiments, layers need not be ordered from highest Shore hardness to lowest Shore hardness as one moves from the external head-protecting shell toward the inside of the headgear.

In some embodiments, the combination of the internal padding with the soft external head-protecting shell allows the headgear to satisfy the Deformation Test, the Shock Absorption Test and/or the Ball Impact Absorption Test. In some embodiments, the combination of the internal padding with the soft external head-protecting shell allows the headgear to satisfy at least two of the aforementioned mechanical tests, e.g., the Deformation Test and the Shock Absorption Test. In some embodiments, the combination of the internal padding with the soft external head-protecting shell allows the headgear to satisfy only two of the aforementioned mechanical tests, e.g., the Deformation Test and the Shock Absorption Test. In some cases, the external head-protecting shell may serve to disperse forces while the internal padding may serve to absorb forces. In some embodiments, when the headgear is subjected to a force, the external head-protecting shell may help to disperse the force across the headgear to distribute the force among more of the internal padding.

In some embodiments, the external head-protecting shell may help to keep the inner padding dry from rain conditions by dispersing the rain over the padding. In some embodiments, the combination of the internal padding with the external head-protecting shell allows the headgear to satisfy one or more of the mechanical tests of proposed ASTM WK36457 when the headgear is subjected to the water immersion condition defined in standard ASTM F1446.

Other types of padding may be included in the headgear besides the primary and secondary padding. For example, padding intended for comfort and/or fit also may be included. Front padding may be included at the inside front of the headgear, against which the wearer's forehead or brow region contacts. In some embodiments, the front padding primarily provides user comfort rather than significant energy absorption.

Temple padding may be included at the inside left and right sides of the headgear, against which the wearer's temple region contacts. In some embodiments, the temple padding may be made of a highly compressible foam to accommodate a wide range of head sizes. In some embodiments, an additional layer of padding may be positioned between the external head-protecting shell and the temple padding. This additional layer of padding may serve to absorb energy from impacts to the headgear.

Figure 8:
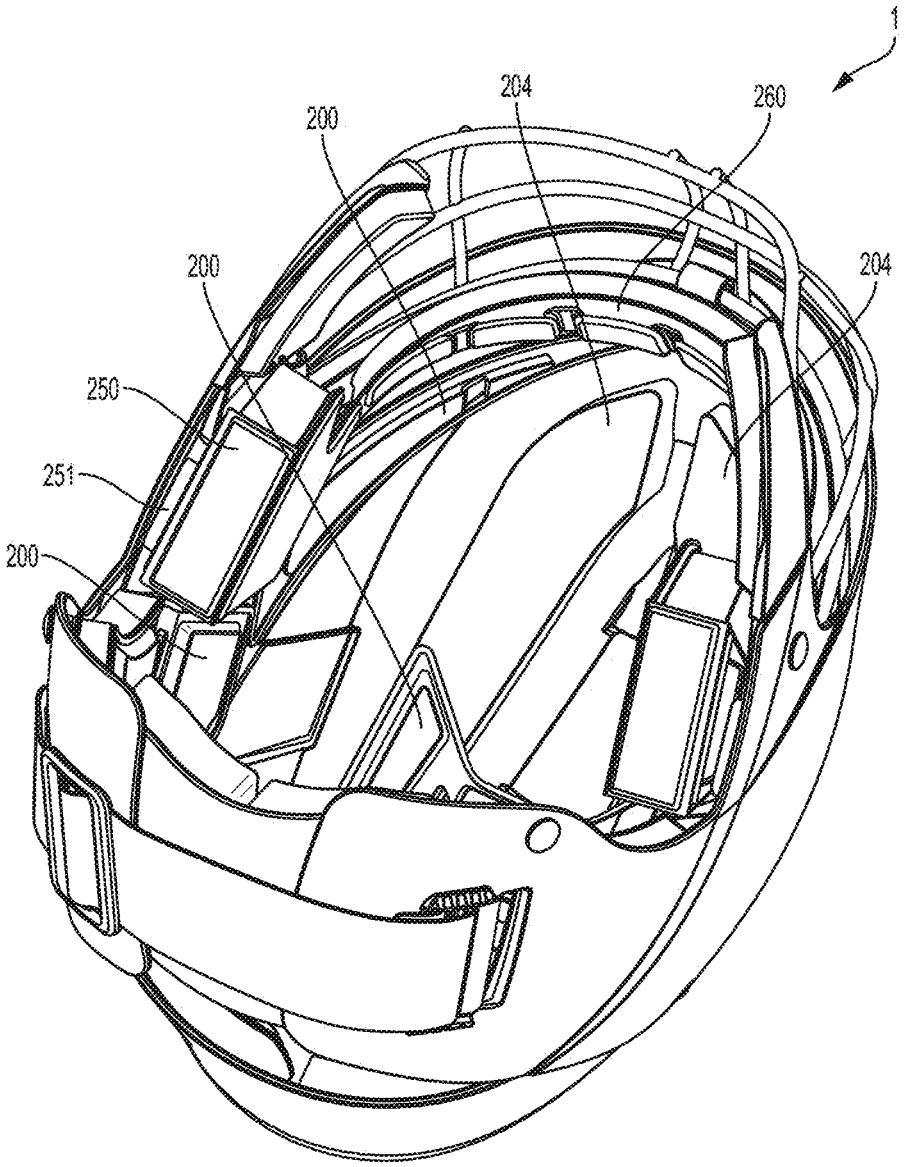
FIG. 8 is a bottom perspective view of headgear with front and temple padding according to one embodiment.

In one illustrative embodiment, shown in FIG. 8, the inside of the headgear includes front padding 260 and temple padding 250. In some embodiments, an additional layer of padding 251 is positioned between the external head-protecting shell 100 and the temple padding 250. In one embodiment, the additional layer of padding 251 is made of the same material as that of the outermost layer 203 of the primary padding 200. In some embodiments, the front padding 260 is made of EVA. In some embodiments, the temple padding 250 is made of an open-cell foam. However, it should be appreciated that for each area of padding other suitable materials may be used.

In some embodiments, the headgear 1 may include a face mask 10 for face and/or eye protection. In some embodiments, the headgear 1 includes a chin strap 30 that may be adjusted and tightened to better secure the headgear to the wearer's head.

The shell may be made of a single unitary piece in some embodiments. For example, material may be thermoformed into a single piece to form the shell, and a subframe may be attached to the shell. Hardware such as connectors may be included on the shell and the shell would still be considered a unitary piece. As with other embodiments, the headgear may include a face mask or other face and/or eye protection.

Rear Closure Arrangement

The inventors have appreciated that ease of donning and securing headgear may help to encourage frequent and proper use of the headgear. Headgear that is difficult to put on and secure may be regarded by wearers as cumbersome and inconvenient. As such, the inventors have recognized the need for headgear that is easy to wear and secure in place. The inventors have also appreciated that headgear with a rear closure arrangement may provide less protection at the closure area, which may render the back of the wearer's head susceptible to injury.

According to one aspect, headgear with a rear closure arrangement that helps to initially stabilize the helmet before fully securing the helmet is provided. According to another aspect, the rear closure arrangement provides protection at the back of the wearer's head.

Figure 9:
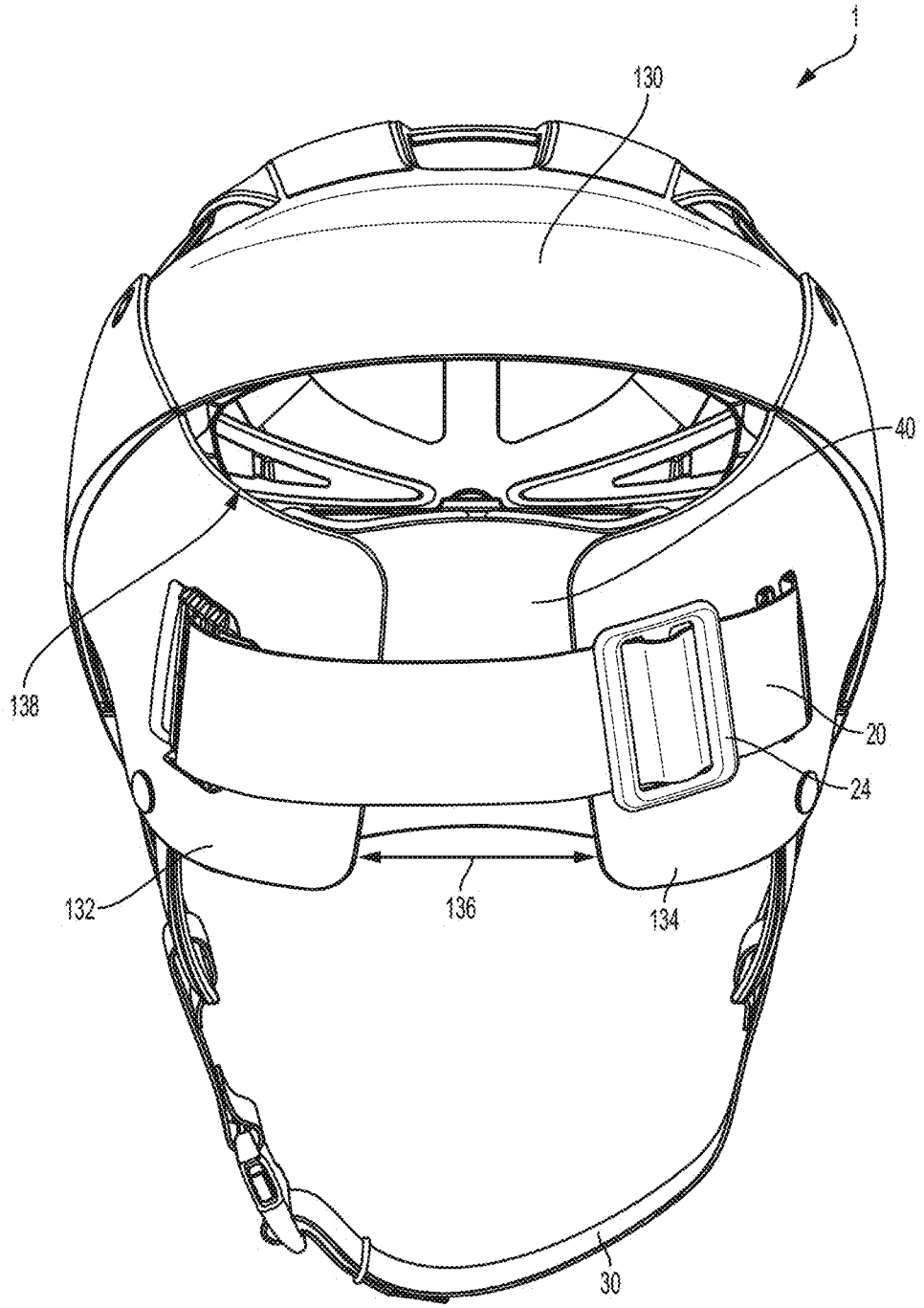
FIG. 9 is a rear view of headgear having a rear closure according to one embodiment.
Figure 10:
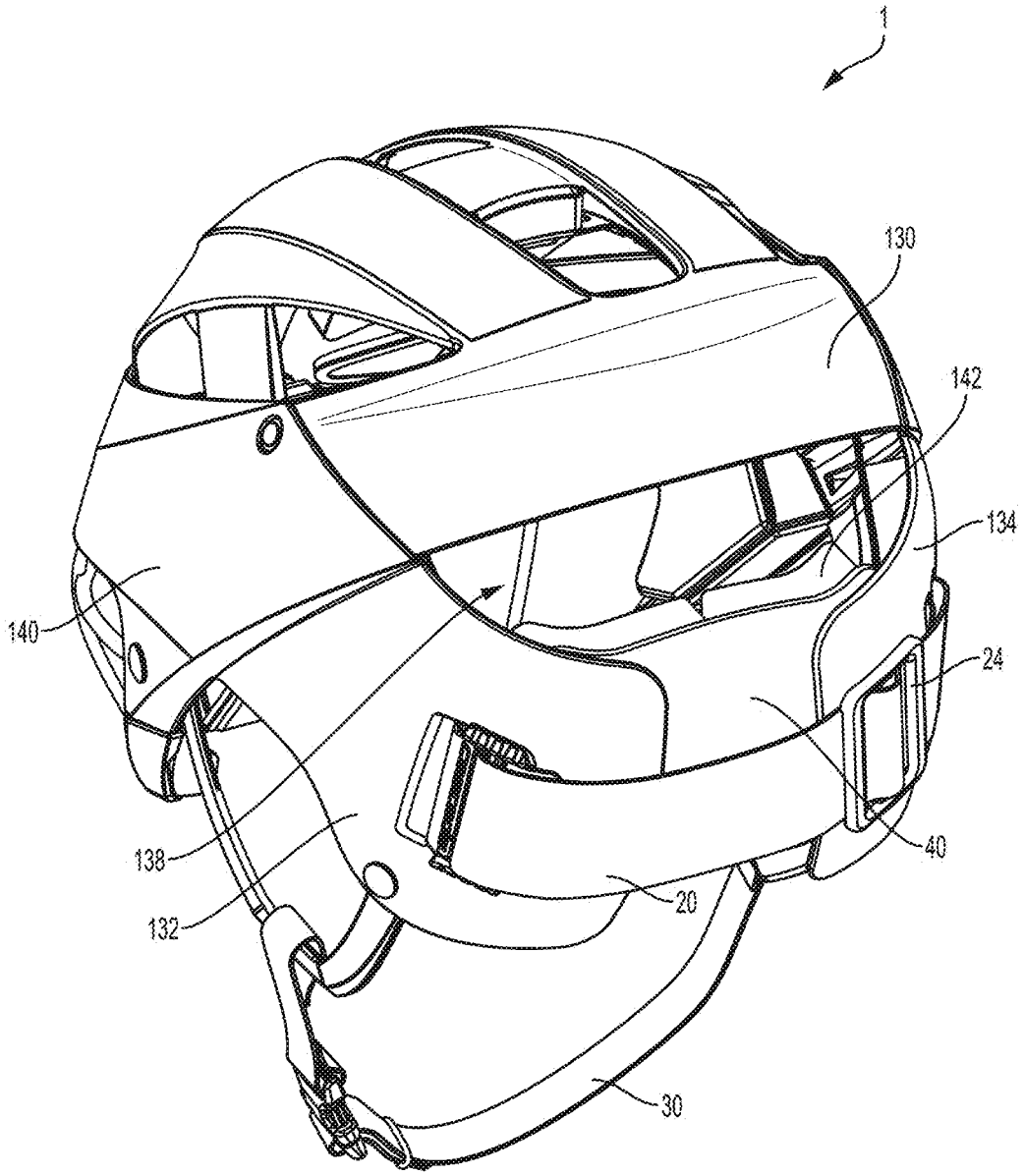
FIG. 10 is a right side, rear perspective view of the headgear shown in FIG. 9.

FIGS. 9-10 depict an embodiment of a headgear 1 having a rear closure arrangement. The rear closure arrangement includes a first end portion 132 and a second end portion 134. In some embodiments, the end portions 132, 134 may be integrally formed with the external head-protecting shell 100. In other embodiments, the end portions 132, 134 are formed separately from the external head-protecting shell 100 and later attached to the external head-protecting shell. In some embodiments, the first and second end portions may be first and second rear flaps. The end portions 132, 134 may be made of a flexible material such that the end portions can flex and move relative to one another. In other embodiments, however, the end portions are made of a rigid material. In such embodiments, the end portions may be joined to the external head-protecting shell 100 via hinges that permit the end portions to move relative to one another. Possible hinge arrangements include a living hinge, butt hinge, T-hinge, strap hinge, gate hinge, or any other suitable hinge.

Each end portion has an outwardly-facing side that faces away from the inside of the headgear, and an inwardly-facing side that faces toward the inside of the headgear. The inwardly-facing side faces toward the wearer's head when the headgear is worn by the wearer. The end portions 132, 134 are moveable relative to one another. In some embodiments, the headgear includes a tightener that is constructed and arranged to tighten the shell around the wearer's head. The tightener may move one or both of the end portions 132, 134 to tighten the shell. The tightener may move the second end portion 134 toward the first end portion 132 and/or may move the first end portion 132 toward the second end portion 134.

In some embodiments, the tightener is a connector. The connector may be attached to the second portion and removably attachable to the first portion. Attachment of the connector to the first end portion may tighten the shell around the wearer's head. In some embodiments, the connector is a strap. In one illustrative embodiment, shown in FIG. 9, a strap 20 is used to bring the end portions 132, 134 toward one another and hold them in position. In some embodiments, the strap 20 is attached to one of the end portions and is constructed and designed to removeably attach to the other end portion. In the embodiment shown in FIG. 9, the strap 20 is attached to the second end portion 134 and is constructed and arranged to removeably attach to the first end portion 132. It should be appreciated that this arrangement may be reversed such that the strap is attached to the first end portion 132 and is constructed and arranged to removeably attach to the second end portion 134.

The strap 20 may removeably attach to the first end portion via hook-and-loop type fasteners, magnets, removable adhesive, mechanical engagement such as a hook and hole arrangement, a ratchet system or dovetail, or via any other suitable arrangement. In one embodiment, best seen in FIG. 2, the first end portion 132 includes a hole 133. The end of strap 20 includes a hook 23 that is partially inserted into the hole 133 and hooks onto an edge of the hole 133. The hook 23 remains engaged to the edge of the hole 133 due to tension in the strap 20. It should be appreciated that the parts may be reversed such that first end portion 132 includes a hook and the end of strap 20 includes a hole or loop that can engage the hook.

It should be appreciated that other types of tighteners may be used. For example, the tightener may be a circular ratchet dial, linear ratchet, linkage, or any other suitable tightener.

As seen in FIGS. 9-10, in some embodiments, the rear closure arrangement may further include a bridge component 40. The bridge component 40 may be attached to each of the first and second end portions 132, 134. In some embodiments, as best seen in FIG. 6, the bridge component 40 is attached to the inwardly-facing sides of the end portions 132, 134. In the embodiment shown in FIG. 6, the bridge component 40 is attached to the first end portion 132 via a strap 42, and is attached to the second end portion 134 via another strap 44. The straps 20, 42 and 44 may comprise a resilient material such that they increase in length when subjected to a tension force, and may resiliently return back to a set length when the force is no longer applied.

The bridge component 40 has an inwardly-facing side that faces toward the wearer's head when the headgear is worn and an outwardly-facing side that faces away from the wearer's head. In some embodiments, when the headgear 1 is worn by a wearer, at least a portion of the bridge component overlaps with at least a portion of one or both of the end portions. The direction of overlap is along the rear to the front of the headgear. In some embodiments, when the tightener tightens the shell, the tightener tightens the shell around the wearer's head and at least a portion of the bridge component overlaps with at least a portion of the first end portion and/or the second end portion. In the embodiment shown in FIG. 10, at least a portion of the bridge component 40 overlaps with at least a portion of each of the end portions 132, 134. In some embodiments, as best seen in FIG. 10, when the headgear 1 is worn by a wearer, the outwardly-facing side of the bridge component 40 abuts against the inwardly-facing side of the end portions 132, 134.

As also seen in FIGS. 9-10, in some embodiments, the headgear may include a rear opening 138, which may receive the wearer's hair (e.g., in the form of a ponytail or bun) and/or serve as an additional vent.

In some embodiments, rear portions of the headgear are positioned at an angle relative to the horizontal when the headgear is worn by a wearer and the wearer is looking straight ahead. For example, as may be seen in the embodiment of FIG. 3, an upper edge 135 of the end portion 134 is positioned at an angle θ relative to the horizontal plane 300, and the headgear 1 is shown in an orientation that would result from the headgear being worn by a wearer looking straight ahead. An upper edge of the end portion on the opposite side of the helmet also may be positioned at the same angle relative to horizontal. In some cases, positioning the end portions at an angle relative to the horizontal plane may create a rear opening in the headgear to receive the wearer's hair and/or serve as an additional vent. An illustrative example of such an opening is rear opening 138 shown in FIG. 3. In some cases, positioning the end portions at an angle relative to the horizontal plane may provide protection at some desired portions of the head while leaving openings at other portions of the head. Angle θ may be between 30 and 50 degrees inclusive, may be between 35 and 45 degrees, may be approximately 40 degrees, or may be any suitable angle. The rear portion 130 may have a lower edge which extends upwardly from side portion 140 to form an angle with the horizontal plane in some embodiments to increase the size of rear opening 138, as shown by way of example in FIG. 3. The angle of the lower edge of rear portion 130 relative to the horizontal plane may be between 25 and 45 degrees inclusive, may be between 30 and 40 degrees, may be approximately 35 degrees, or may be any suitable angle.

In some embodiments, the downwardly-angled rear portions may not be end portions, but instead may be one continuous shell component which extends from one side portion to the opposite side portion.

The bridge component 40 may ease the process of donning headgear 1. Prior to placing the headgear 1 on the wearer's head, the strap 20 is detached from one of the end portions such that the end portions can be moved away from one another to widen the headgear circumference and make it easier for the wearer's head to be inserted into the headgear. With the bridge component 40 attached to each end portion, the bridge component 40 limits the separation distance between the end portions. The bridge component also fills the separation distance between the end portions to provide a continuous, gap-free headgear circumference. Without the bridge component, the headgear may slide forward off the wearer's head as the wearer's head passes through the space between the end portions. In combination with the sides and front portions of the headgear, the bridge component 40 may provide a headband-like tension effect around the wearer's head that helps to initially stabilize the headgear in place.

If the wearer wishes to pass hair through the rear opening 138 of the headgear, such a step may be performed while the headgear is initially placed on the head. As the headgear is placed onto the wearer's head, the wearer reaches one hand above the bridge component through the rear opening 138 to grasp the hair and pull it through the rear opening 138. The bridge component helps to keep hair within the rear opening 138. Without the bridge component, hair may fall through the space between the end portions. The user would have to hold hair above the end portions while closing the end portions to prevent hair from falling through the space between the end portions, which could make donning the headgear a cumbersome process.

Next, with the headgear initially stabilized on the wearer's head, the wearer reaches behind to grasp the free end of the rear strap 20, pulls the strap end toward the first end portion 132, and attaches the strap to the end portion 132. The rear strap 20 may have a strap length adjustment mechanism 24 to allow the wearer to adjust the length of the strap 20 to tighten or loosen the fit of the headgear. In some cases, having the bridge component 40 initially stabilize the headgear on the wearer's head permits the wearer to attach the rear strap more easily, such as by using only one hand. In some cases, a second hand may be used to prevent the headgear from rotating on the head while the rear strap is pulled toward the opposing end portion.

If a chin strap 30 is included, the wearer then may buckle the chin strap and adjust the length of the chin strap.

In some embodiments, the bridge component 40 allows the wearer to angle the headgear upward in a tilted up position without the headgear falling off to, for example, drink water, cool the head, or to move the face mask 10 away from the face.

As mentioned above, the inventors have appreciated that headgear with rear closure arrangements may have less protection at the closure area that may render the back of the wearer's head susceptible to injury. As shown in FIG. 9, in some cases, even with the strap 20 attached to both end portions 132, 134, a separation distance 136 may exist between the end portions 132, 134. As also seen in FIG. 9, bridge component 40 fills the separation distance 136 between the end portions, thus providing protection to the rear portion of the wearer's head.

In some embodiments, padding may be attached to bridge component 40 to provide further protection to the rear portion of the wearer's head. As seen in FIGS. 5-6 and 10, rear padding 142 is attached to the inwardly-facing surface of the bridge component 40. Rear padding 142 may have one or more layers similar to the primary and secondary padding discussed above.

Cheek Fit Pads

The inventors have appreciated that precise contact with a front portion of the wearer's head can be challenging because each wearer's facial anatomy may differ. Traditional goggles or face masks which have an elastic band that fits around the wearer's head are held in contact with the wearer's face by the tension force from the elastic band that pulls the front of the goggles/face mask toward the front of the wearer's face. When the goggles are not attached to a helmet or other headgear, the goggles are free to be pulled tight against the wearer's face. The inventors have recognized that, in some arrangements, headgear with integrated goggles/face mask may not allow the goggles/face mask to be pulled toward the wearer's face to make contact with a front portion of the wearer's head. Specifically, a gap may occur between the goggles/face mask and the wearer's cheekbone area. In some embodiments, the line of action of the headband-like tension provided by the bridge component discussed previously may be higher up on the wearer's head, e.g. at the brow line or higher, rather than at the cheekbone area.

The inventors have appreciated that a gap between the goggles/face mask and the wearer's cheekbone area may give rise to injury. With such a gap, impacts to the front of the headgear may cause the goggles/face mask to slide backwards and/or rotate downwards and hit the wearer's face, which may result in injury. The inventors have thus recognized a need for improving headgear to cheekbone area contact that does not rely on using a tension force to pull goggles/face mask to the cheekbone area.

Figure 11:
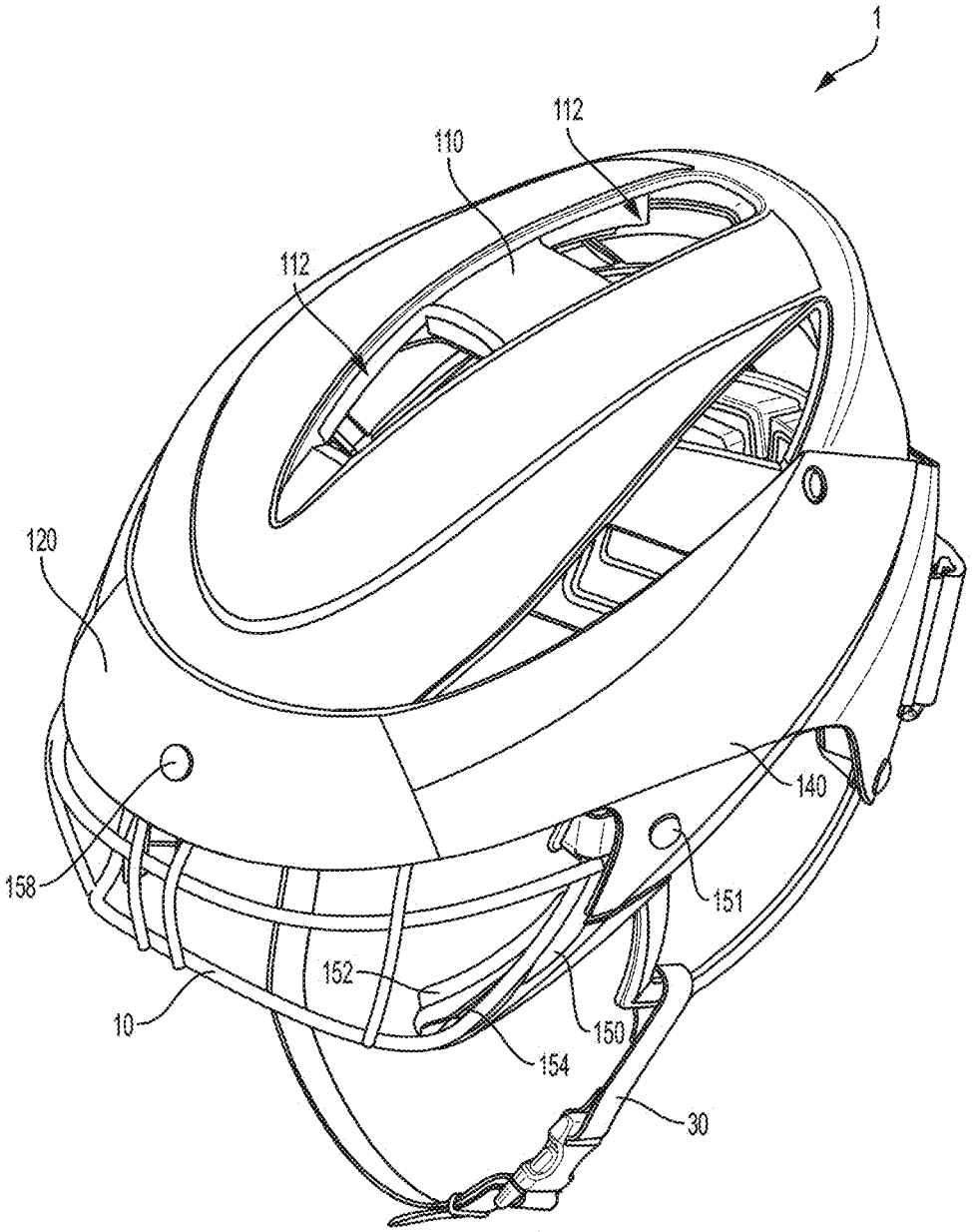
FIG. 11 is a right side, front perspective view of headgear having a cheekbone extension member according to one embodiment.

According to one aspect, headgear is provided with replaceable, removable fit pads such that the wearer can select a fit pad that provides a proper fit to a front portion of the wearer's head. As seen in FIGS. 2, 3 and 11, each side of the headgear 1 includes a cheekbone extension member 150 to at least partially cover a cheekbone area of a wearer's head. The cheekbone extension member 150 has an inwardly-facing surface that faces toward the wearer when the headgear is worn and an outwardly-facing surface that faces away from the wearer's head. The inwardly-facing surface of the cheekbone extension member 150 faces toward the wearer's head when the headgear is worn. In the embodiment shown in the figures, the cheekbone extension member is a component that is formed separately from the external head-protecting shell 100 and is then attached to the external head-protecting shell 100. For example, as shown in FIGS. 2 and 11, a fastener 151 is used to attach the cheekbone extension member 150 to the external head-protecting shell 100. In other embodiments, the external head-protecting shell and the cheekbone extension member are integrally formed as a single monolithic component.

In some embodiments, a cheekbone fit pad is removeably attachable to the cheekbone extension member. The cheekbone fit pad may be attached to the cheekbone extension member such that the cheekbone fit pad covers at least a portion of the inwardly-facing surface of the cheekbone extension member. The actual attachment of the fit pad need not be on the inwardly-facing surface of the cheekbone extension member. For example, the fit pad could be adhered to the sides of the cheekbone extension member and wrap over the inwardly-facing surface of the cheekbone extension member. In other embodiments, the actual attachment of the fit pad is on the inwardly-facing surface of the cheekbone extension member.

As best seen in FIGS. 6 and 11, a cheekbone fit pad 152 is attached to the cheekbone extension member 150. In this embodiment, the actual attachment of the fit pad 152 is on the inwardly-facing surface of the cheekbone extension member 150. The fit pad 152 may be attached to the cheekbone extension member 150 via hook-and-loop type fasteners, removable adhesive, removable mounting putty, or any other suitable removable attachment arrangement. As such, the fit pad 152 may be removed from the cheekbone extension member 150 and replaced with a different fit pad. The new fit pad may have a different shape, such as a different thickness, surface area and/or surface contour, to provide a better fit to the cheekbone area of the wearer's face. In some embodiments, a properly fitting fit pad is one that makes contact with the wearer's cheekbone area when the headgear is fully secured on the wearer's head. This arrangement may also allow users to replace old, worn out fit pads with new fit pads.

In some embodiments, a second fit pad may be added on top of and attached to a first fit pad that is already attached to the cheekbone extension member, resulting in a combined fit pad of greater thickness. A user can continue stacking and attaching fit pads until a desirable fit is reached.

In some embodiments, a user can switch out and attach fit pads to the cheekbone extension member while the headgear is worn on the wearer's head, either in an initially stabilized state or in a fully secured state. The wearer can adjust the fit of the headgear to the cheekbone area while wearing the headgear, thus avoiding having to repeatedly put on and remove the headgear after each adjustment.

The face mask 10 is a wire cage eye mask in some embodiments. The wire cage includes multiple wire portions which may be formed of a single wire or a plurality of wires attached to one another at various locations to form the eye mask. The cheekbone extension members 150 may include forwardly-facing grooves 154 in which a wire portion is supported. Such an arrangement helps to support the eye mask in some embodiments.

The face mask 10 is attached to the head-protecting shell with a stiff interface 156 in some embodiments. The interface 156 may be formed of a hard plastic or a metal, or any other suitable material. The interface 156 may be attached to the shell with any suitable fastener(s) 151, 158, such as screws, bolts, or rivets as some examples. In this manner, the face mask 10 is integrated with the protective head gear without the use of a strap to attach the face mask. The cheekbone extension 150 members may be integral to the interface 156, or may be attached to the interface 156 with any suitable fastener(s).

Instead of a wire cage, the face mask may be goggles in some embodiments. For example, goggles with a polycarbonate lens may be integrated with the protective headgear. The goggles are supported by and held to the protective headgear without the use of a strap in some embodiments. In other embodiments, the goggles may be attached to the helmet with one or more straps.

The above aspects and embodiments may be employed in any suitable combination, as the present invention is not limited in this respect.

It should also be understood that, unless clearly indicated to the contrary, in any methods claimed herein that include more than one step or act, the order of the steps or acts of the method is not necessarily limited to the order in which the steps or acts of the method are recited.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A women's lacrosse protective headgear comprising:

an external head-protecting shell, the external head-protecting shell having a crown portion, left and right side portions and a rear portion; and an inner padding;

wherein the external head-protecting shell has an outermost headgear layer having a hardness of 25 to 70 Shore D; and wherein the headgear is configured to satisfy at least two of the following tests of proposed ASTM WK36457: the Deformation Test, the Shock Absorption Test, and the Ball Impact Absorption Test, and wherein one of the at least two tests that the headgear is configured to satisfy is the Deformation Test.

2. The women's lacrosse protective headgear of claim 1, wherein the headgear satisfies only two of the Deformation Test, the Shock Absorption Test, and the Ball Impact Absorption Test.

3. The women's lacrosse protective headgear of claim 1, wherein the headgear satisfies only the Deformation Test and the Shock Absorption Test.

4. The women's lacrosse protective headgear of claim 1, wherein the headgear satisfies the Deformation Test, the Shock Absorption Test, and the Ball Impact Absorption Test.

5. The women's lacrosse protective headgear of claim 1, wherein the external head-protecting shell comprises a thermoplastic polymer having a void fraction of less than 20%.

6. The women's lacrosse protective headgear of claim 1, wherein the external head-protecting shell has a hardness of 30 to 60 Shore D.

7. The women's lacrosse protective headgear of claim 6, wherein the inner padding comprises foam.

8. The women's lacrosse protective headgear of claim 7, wherein the external head-protecting shell has a thickness of between 0.050 to 0.100 inches inclusive, and the foam has a thickness of between 0.05 and 1.0 inches inclusive.

9. The women's lacrosse protective headgear of claim 1, further comprising a face mask attached to the headgear without a strap.

10. The women's lacrosse protective headgear of claim 1, wherein portions of the headgear are integral with the external head-protecting shell, and the portions are made of a flexible material such that the portions move relative to one another.

11. The women's lacrosse protective headgear of claim 1, wherein the external head-protecting shell has a thickness of between 0.05 inches to 0.15 inches inclusive.

12. The women's lacrosse protective headgear of claim 1, wherein the inner padding has first layer and a second layer, with the first layer being closer to the external head-protecting shell than the second layer is to the external head-protecting shell, wherein the first layer has a higher Shore D hardness than the second layer.

13. The women's lacrosse protective headgear of claim 1, wherein the external head-protecting shell comprises a thermoplastic polyurethane.

14. The women's lacrosse protective headgear of claim 1, wherein the external head-protecting shell is made of a single unitary piece.

15. The women's lacrosse protective headgear of claim 1, wherein the external head-protecting shell crown portion has a single layer.

16. The women's lacrosse protective headgear of claim 1, wherein the external head-protecting shell crown portion is made of a single material.

17. The women's lacrosse protective headgear of claim 1, further comprising at least one of paint, decals, and stickers applied to an outer surface of the head-protecting shell.

* * * * *